United States Patent [19]

Illk

[11] Patent Number: 4,680,185

[45] Date of Patent: Jul. 14, 1987

[54] INFUSION PACKAGE

[76] Inventor: Barbara D. Illk, 17658 NE. Couch, Portland, Oreg. 97230

[21] Appl. No.: 826,742

[22] Filed: Feb. 6, 1986

[51] Int. Cl.[4] ..... A47G 19/16

[52] U.S. Cl. ..... 426/83; 206/15; 383/85; 383/86; 426/77; 426/110

[58] Field of Search ..... 426/77–84, 426/112, 115, 394, 110; 206/15; 99/295, 323, 321; 383/86, 87, 86.1, 86.2, 31, 85; 229/77

[56] References Cited

U.S. PATENT DOCUMENTS

| | | | |
|---|---|---|---|
| 723,287 | 3/1903 | Lawson et al. . | |
| 952,375 | 3/1910 | Stanley | 383/86 |
| 1,171,896 | 2/1916 | Simpson | 383/86 |
| 1,182,580 | 5/1916 | Maxfield | 383/86 |
| 1,359,461 | 11/1920 | Luce | 383/86 |
| 1,395,642 | 11/1921 | Hirschhorn . | |
| 1,467,919 | 9/1923 | Blumenthal | 383/86 |
| 1,677,397 | 7/1928 | Mock | 426/81 |
| 1,732,702 | 8/1929 | Mitchell . | |
| 1,940,900 | 12/1933 | Barnard | 383/86 |
| 1,947,523 | 2/1934 | Hirschhorn | 426/83 |
| 2,015,854 | 10/1935 | Ingram | 426/83 |
| 2,278,156 | 3/1942 | Sterling | 383/85 |
| 2,307,998 | 1/1943 | Eaton . | |
| 2,431,680 | 12/1947 | Barnett . | |
| 3,222,235 | 12/1965 | Buchner . | |
| 3,237,550 | 3/1966 | Christopher | 426/80 |
| 3,373,677 | 3/1968 | Petrozzo | 426/77 |
| 3,539,355 | 11/1970 | Kasakoff | 426/80 |
| 3,556,392 | 1/1971 | Robin | 426/83 |
| 4,055,668 | 10/1977 | Kopp . | |

FOREIGN PATENT DOCUMENTS

| | | | |
|---|---|---|---|
| 2217927 | 10/1973 | Fed. Rep. of Germany | 426/77 |
| 7610596 | 6/1977 | Netherlands | 426/77 |
| 6332 | of 1913 | United Kingdom | 383/86 |
| 887850 | 1/1962 | United Kingdom | 426/77 |

*Primary Examiner*—Steven Weinstein

*Attorney, Agent, or Firm*—John W. Stuart

[57] ABSTRACT

An infusion package, such as a tea bag, having porous side panels and an open mouth through which material may be inserted. Edges of the package at the mouth are foldable over each other to close the mouth. A string on the folded over portions is extended through an aperture remote from the mouth and serves to inhibit unfolding.

10 Claims, 7 Drawing Figures

INFUSION PACKAGE

BACKGROUND AND SUMMARY OF THE INVENTION

This invention relates to an infusion package, such as a tea bag, which the individual user may fill with material to be infused into a liquid, with simplified closing and holding means.

Infusion packages, such as tea bags, generally are known. For the most part, those presently in use are manufactured items, which come to the user already prepackaged and fully sealed along all of their edge margins. A user may desire to have a disposable bag into which they can insert their own infusion material, such as tea leaves, simply and easily close the package, and have means for holding it closed during the infusion process.

A general object of the present invention is to provide a novel infusion package which provides for the user a disposable infusion package, such as a tea bag, which fulfills the desired characteristics set out above.

More specifically, an object of the invention is to provide a novel infusion package which has an open mouth, portions which can be folded over to close the mouth, and further includes easily operated holding means for holding the package in a closed condition.

Another object of the invention is to provide a novel infusion package which has opposed porous side panels which are sealingly joined together along a major portion of their adjacent edge margins, and which are unjoined in a selected region to provide a mouth through which material may be placed therein. Portions of the side panels adjacent the open mouth may be folded over to close the mouth and an elongate flexible member attached to one of the side panels adjacent the mouth is capable of being extended through an aperture remote from the mouth and also held by the user to provide dipping of the infusion package and also maintaining the package in a closed condition. The means providing the aperture for receiving the holding member does not extend into the interior of the package, and thus the integrity of the package is maintained so that solid materials within the package do not escape during the infusion process.

Drawings

These and other objects and advantages of the invention will become more clearly apparent as the following description is read in conjunction with the drawings wherein.

Description of a Preferred Embodiment of the Invention

Figure 1:
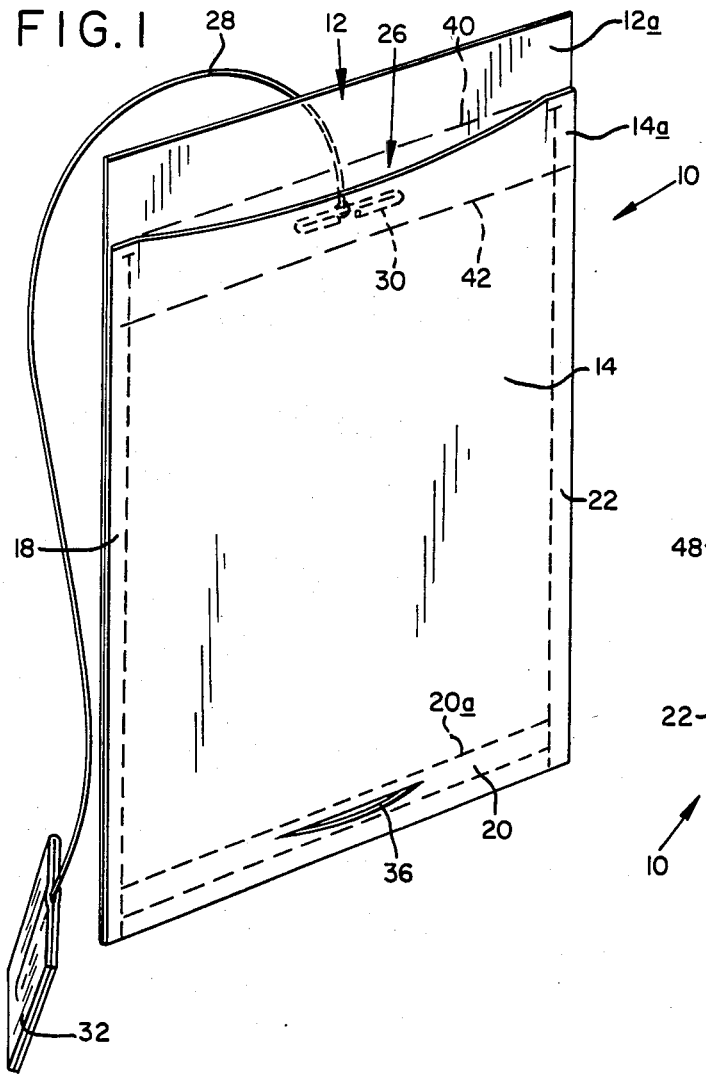
FIG. 1 is a perspective view of an infusion package according to an embodiment invention ready to be filled for use.

Referring to the drawings, and first more specifically to FIG. 1, at 10 is indicated generally a teabag, also referred to herein as an infusion package constructed according to an embodiment of the present invention. It includes a first porous, or water pervious, rectangular side panel 12 and a second porous, or water pervious, rectangular side panel 14.

The side panels are sealingly secured together along adjacent edge margins in regions denoted 18, 20, 22. Such joining of the majority of the edge margins of the side panels 12, 14 may be accomplished either by adhesive joining, stitching, or by methods which use neither stitching or adhesives, one of which such methods being described in U.S. Pat. No. 3,222,235 to Buchner.

The side panels 12, 14 are unjoined along one region to define an open mouth 26 through which material may be inserted into the package. The joining together of the two panels 12, 14 places them in face-to-face relationship with opposed, outer surfaces, facing away from each other.

An elongate string, also referred to herein as a flexible holding member, 28 is secured to the outer side of panel 12 adjacent mouth 26. The string may be attached by way of a staple 30. A rectangular tag 32 is secured to the opposite end of string 28.

As is best seen in FIG. 1, an aperture 36 in the form of a slit wider than tag 32 is cut through the edge margins of panels 12, 14 remote from mouth 26. The panels are joined along a band of substantial width in region 20 which extends inwardly to dashed line **20*a*. Aperture 36 is in a portion of the side panels spaced outwardly toward their extreme outer edge margins from said joining line 20*a*. Thus it will be seen that aperture 36** does not extend into the interior, material holding portion, of the package.

Figure 2:
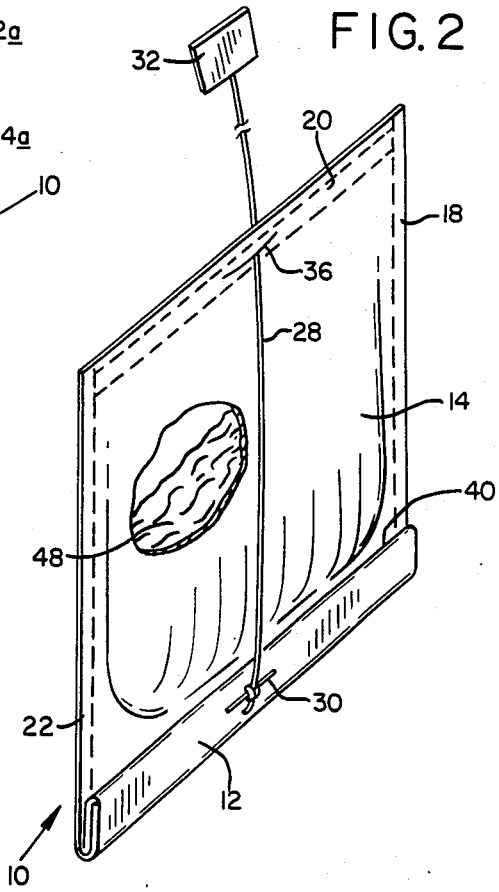
FIG. 2 is a perspective view of the package when filled, folded over, and inverted from the orientation illustrated in FIG. 1, ready for use.
Figure 3:
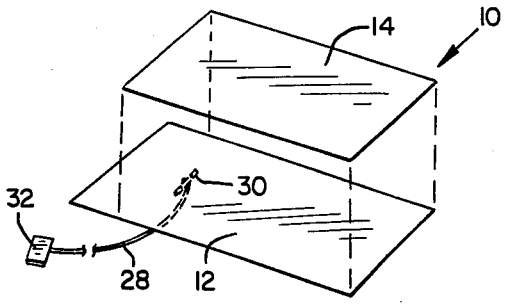
FIG. 3 is an exploded view illustrating the opposed side panels prior to joining.
Figure 4:
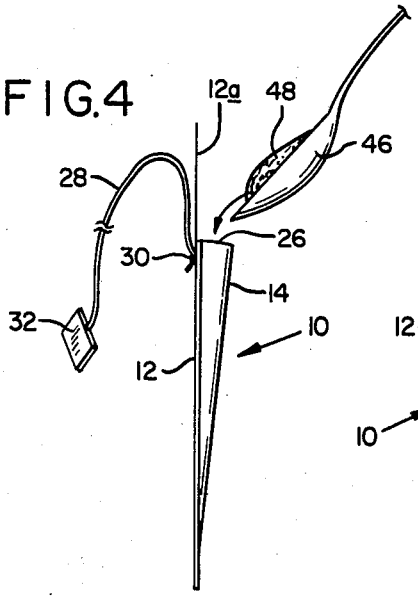
FIGS. 4–7 are step-by-step illustrations of use of the package of the invention.

As is best seen in FIGS. 1, 3 and 4, side panel 12 is longer than panel 14 and has a flap portion **12*a* which extends beyond mouth 26. Flap portion 12*a* may be folded along a first fold line 40 downwardly over mouth 26 and over an outer side portion of side panel 14, initially to close the mouth. Subsequently, flap portion 12*a* and an upper marginal portion 14*a* of side panel 14 may be folded over again along a second fold line 42 substantially parallel to fold line 40 to the position illustrated in FIGS. 2 and 6**, to more securely close the mouth of the package.

Figure 6:
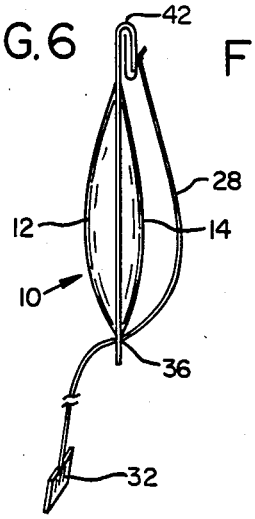
Figure 7:
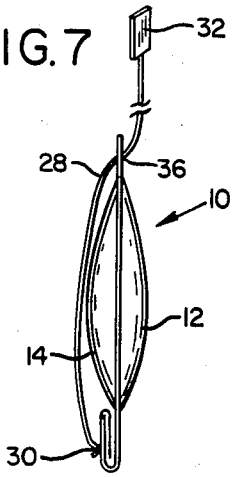

String 28 is secured by staple 30 to the package in a region intermediate fold lines 40, 42. Thus, when the upper marginal portions of the side panels have been folded over, as illustrated in FIGS. 2 and 6, the connection of the string with the panels is on the outside of the folded over portion. Tag 32 and a portion of string 28 may be extended through aperture 36 as illustrated in FIGS. 2, 6 and 7 to hold the folded over portions in place to maintain closure of the package.

Figure 5:
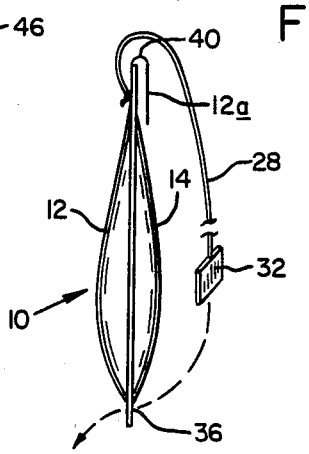

Explaining operation of the package, the user receives it substantially in the form illustrated in FIGS. 1 and 4. The user may introduce material, such as tea leaves, into the package through mouth 26, as by pouring the same therein with a spoon 46 as illustrated in FIG. 4. The tea leaves 48, shown in FIG. 4 and through a broken away side portion of the bag in FIG. 2, are of such size that they will not penetrate the porous structure of side panels 12, 14. Once the material is introduced into the package, flap portion **12*a* of side panel 12 is folded over along fold line 40 to the position illustrated in FIG. 5. Subsequently, side panel 12 and upper portion 14*a* of side panel 14 are folded over as illustrated in FIG. 6 along fold line 42 to more securely close the package. Tag 32 and string 28 then are fed down and through aperture 36**. The user then grasps tag 32 and string 28, inverting the package as illustrated in FIG. 7 and may dip it in an infusion liquid, such as heated water, for use. With the bag thus inverted and the weight of the package and material held therein bearing against the string, it serves to maintain the folded over portions of the bag in closed position.

Whereas a preferred embodiment of the invention has been described herein, it should be apparent to those skilled in the art that variations and modifications are possible without departing from the spirit of the invention.

I claim:

1. An infusion package comprising a first water pervious side panel and a second water pervious side panel, said side panels being joined together adjacent their edge margins to define an enclosure with one open side forming a mouth through which material may be added to the package, said side panels being flexible and capable of having portions thereof folded over toward one side of the package to close said mouth, an elongate flexible member secured adjacent one of its ends to the outer side of said first side panel in the region that is to be folded over, such that said member remains on the outside of said package when said portions of the panels are folded over, and means defining an aperture on said package adjacent the joined edge margins of said side panels in a region opposite said mouth but not extending into the interior of the package, said aperture being adapted to receive a portion of said flexible member therethrough when said flexible member is fed down from the folded portions and across said second side panel with remainder portions of said member remote from said secured one end extending beyond through and beyond said aperture in a direction away from said mouth, such that a user may hold said remainder portion of said flexible member to suspend said package in an inverted orientation with the folded over portions of the side panels at the bottom of the suspended package and maintained closed by said flexible member in said inverted position.

2. The package of claim 1, wherein said side panels are sealingly joined together along a joining line spaced a distance inwardly from their extreme outer edge margins in a region spaced from said mouth, and said aperture is defined in a portion of a side panel spaced outwardly from said joining line.

3. The package of claim 1, wherein said flexible member is a string secured at one of its ends to said outside surface of said first panel adjacent said mouth.

4. The package of claim 1, wherein said first side panel extends beyond said second side panel adjacent said mouth and is adapted to be folded along a first fold line over said second side panel initially to close said mouth, and said first and second panels are adapted to be folded over along a second line substantially parallel to said first fold line to provide more secure closure.

5. The package of claim 4, wherein said flexible member is connected to the side of said first side panel facing away from said second side panel in a region between said first and second fold lines.

6. An infusion package comprising first and second water pervious side panels joined together adjacent a majority of their edge margins to define and enclosure with one open side forming a mouth through which material may be added to said package, said side panels having opposed outer faces, said first side panel having a first portion extending beyond said second side and being foldable along a first fold line adjacent said mouth over said second side panel initially to close said package, and portions of said first and second panels being foldable together along a second fold line substantially parallel to said first fold line to provide more secure closure, an elongate flexible member secured adjacent one of its ends to the outer face of said first side panel between said first and second fold lines, and means defining an aperture on said package adjacent the joined edge margins of said side panels in a region opposite said mouth but not extending into the interior of the package, said aperture being adapted to receive a portion of said flexible member therethrough when said flexible member is fed down from the folded portions and across said second side panel with remainder portions of said member remote from said secured one end extending through and beyond said aperture in a direction away from said mouth, such that a user may hold said remainder portion of said flexible member to suspend said package in an inverted orientation with the folded-over portions of the side panels at the bottom of the suspended package and maintained closed by said flexible member in said inverted position.

7. The package of claim 6, wherein edge margins of said side panels spaced from said mouth are sealingly joined together in a region spaced inwardly from their extreme outer edges and said aperture is defined in a portion of a side panel spaced outwardly from said joining line.

8. An infusion package comprising first and second substantially rectangular water pervious side panels disposed in face-to-face relationship with opposed outer faces, said panels being sealingly secured together along three of their adjacent edge margins and unsecured along their other edge margins to define an open mouth through which material may be added to said package, said first panel being longer than said second panel with a first portion thereof extending beyond said second panel adjacent said mouth, said first portion of said first panel being foldable along a first fold line over a portion of the outer face of said second panel to initially close said mouth, and portions of said first and second panels being foldable together toward the outer surface of the second panel along a second fold line spaced inwardly from said first fold line to more securely close said mouth, an elongate flexible holding member secured to the outer face of said first panel between said first and second fold lines, and means defining an aperture on said package adjacent the joined edge margins of said side panels in a region opposite said mouth but not extending into the interior of the package, said aperture being adapted to receive a portion of said flexible member therethrough when said flexible member is fed down from the folded portions and across said second side panel with remainder portions of said member remote from said secured one end extending through and beyond said aperture in a direction away from said mouth, such that a user may hold said remainder portion of said flexible member to suspend said package in an inverted orientation with the folded-over portions of the side panels at the bottom of the suspended package and maintained closed by said flexible member in said inverted position.

9. The package of claim 8, wherein said first and second panels in a remote region opposite said mouth are sealingly joined along a line space a distance inwardly from the extreme outer edges of the panels and said aperture extends through a panel between said joining line and said extreme outer edge, whereby the integrity of the package is maintained to hold material therein.

10. The package of claim 9, wherein said remote regions of said panels are sealingly joined along a band of some width and said aperture is defined in a mid-region of said band.

* * * * *